United States Patent [19]

Martin et al.

[11] Patent Number: 4,615,068

[45] Date of Patent: Oct. 7, 1986

[54] CONVERTIBLE VACUUM AND POWDER CARPET CLEANER

[75] Inventors: William J. Martin, Watervliet; Keith E. Carr, Lincoln Township, Berrien County; Edward C. Peterson, St. Joseph Township, Berrien County, all of Mich.

[73] Assignee: Whirlpool Corporation, Benton Harbor, Mich.

[21] Appl. No.: 775,379

[22] Filed: Sep. 12, 1985

Related U.S. Application Data

[62] Division of Ser. No. 513,332, Jul. 13, 1983, Pat. No. 4,549,328.

[51] Int. Cl.[4] ..... A47L 5/36

[52] U.S. Cl. ..... 15/323; 15/328

[58] Field of Search ..... 15/320, 321, 328, 323, 15/377

[56] References Cited

U.S. PATENT DOCUMENTS

| | | | |
|---|---|---|---|
| 2,601,694 | 7/1952 | White | 15/328 |
| 3,184,775 | 5/1965 | Downey et al. | 15/328 |
| 3,310,828 | 3/1967 | Clark et al. | 15/328 |
| 4,204,297 | 5/1980 | Yasunaga et al. | 15/323 |
| 4,457,042 | 7/1984 | Jones et al. | 15/377 X |

*Primary Examiner*—Chris K. Moore

*Attorney, Agent, or Firm*—Wood, Dalton, Phillips, Mason & Rowe

[57] ABSTRACT

Structure for converting a powered brush vacuum cleaner selectively to define a powder carpet cleaning apparatus. The conversion structure includes a shroud received within the nozzle. In one form, the shroud is movably mounted within the nozzle for selective disposition in a retracted position, permitting use of the nozzle in the normal vacuum cleaning manner, and in an operative position blocking the entrance to the suction passage for permitting the unit to be used as powder carpet cleaner. The shroud defines a smooth inner surface surrounding a portion of the brush for effectively preventing clogging of the space about the brush during the carpet cleaning operation. An opening is provided in the nozzle wall for access to the movable shroud in effecting manipulation thereof between the retracted and operative positions. In another form, the shroud is fixedly mounted within the nozzle and a closure is removably installed for closing the entrance to the suction passage when it is desired to use the unit as a carpet cleaner. In the illustrated embodiment, the closure includes a tongue received in a socket portion of the shroud in the installed arrangement. Provisions are made for accommodating bridging elements extending across the nozzle opening when necessary.

14 Claims, 10 Drawing Figures

136
134a
133a
117
135a
214
242
212
210
138
134b
137
135b
140
141
134c
135c
139
133
132
122
110
111
118
121
130
134
136
250
247
249
243
244
248
246
245

CONVERTIBLE VACUUM AND POWDER CARPET CLEANER

This is a division of application Ser. No. 513,332 filed July 13, 1983, now U.S. Pat. No. 4,549,328, issued Oct. 29, 1985.

BACKGROUND OF THE INVENTION

1. Field of the Invention

This invention relates to vacuum cleaners and in particular to means for converting a vacuum cleaner to a powder carpet cleaner when desired.

2. Description of the Background Art

In one form of floor cleaning apparatus disclosed in U.S. Pat. No. 2,293,722 of Carl E. Erickson, a vacuum sweeper is provided with means for converting the sweeper to a rug shampooing device. The conversion structure includes a brush journaling casing and a dirt receiver adapted to be mounted in the brush housing of the sweeper in place of the conventional sweeper brush.

In U.S. Pat. No. 1,815,225, Harry B. White discloses structure for modifying a conventional vacuum cleaner including a shroud for the polishing brush arranged to substantially seal off the fan intake when the vacuum cleaner is utilized as a floor polishing machine. The nozzle of the vacuum cleaner includes a pivoted mounting frame for mounting the agitator or polishing brush attachment. The polishing attachment defines a shroud member for protecting the interior of the cleaner against fouling by polish or wax thrown by the brush.

Another means for modifying a vacuum cleaner for use in polishing is disclosed in U.S. Pat. No. 2,601,694 of Harry B. White. As shown therein, a shroud is provided comprising two arcuate portions pivoted to the underside of a longitudinally extending portion of the supporting frame. The shroud portions are spring pressed outwardly against the bristles of the brush and inserted upwardly into the nozzle mouth whereupon release of the spring biased shroud portions are held in the nozzle mouth without the use of extraneous fasteners. The purpose of the shroud is to close off the suction produced by the fan when the polishing attachment is in place to reduce the load on the motor and prevent it from overheating.

SUMMARY OF THE INVENTION

The present invention comprehends a vacuum cleaner apparatus having improved means for converting the vacuum cleaner to a powder carpet cleaner.

The invention comprehends the provision of improved means for selectively preventing application of suction to the nozzle of the vacuum cleaner while concurrently permitting energization of the powered brush thereof to effect a powder carpet cleaning operation, including a shroud, means movably mounting the shroud within the nozzle to extend partially about the brush, and means for effecting selective disposition of the shroud (a) in a retracted position permitting suction to be applied to the nozzle at said brush for picking up dirt loosened by the brush, and (b) in an operative position preventing application of suction to the nozzle through the wand for permitting the brush to be operated as a carpet cleaning means for working cleaning powder against the floor surface for extraction of dirt from the carpet and subsequent removal of the extracted dirt and cleaning powder to the collector by suction applied through the wand upon return of the shroud to the retracted position.

In the illustrated embodiment, the shroud defines a substantially smooth surface facing the brush for preventing clogging of the brush by the cleaning powder during operation of the brush as a carpet cleaning brush.

The nozzle, in the illustrated embodiment, is provided with an opening affording access to the means for effecting selective disposition of the shroud.

Means are provided for yieldingly retaining the shroud in the selected dispositions.

The shroud further defines means for guiding loosened dirt into one end of the wand during dirt pickup operation.

The guiding means further defines means for limiting the movement of the shroud in one direction to the retracted position.

In another embodiment, the means for selectively preventing application of suction to the nozzle includes closure means releasably mounted to the shroud for blocking the opening to the wand for permitting the brush to be operated as a carpet cleaning means for working cleaning powder against the floor surface for extraction of dirt from the carpet and subsequent removal of the extracted dirt and cleaning powder from the carpet to the collector by suction applied through the wand upon removal of the closure means from the shroud.

In the illustrated embodiment, the closure means and shroud cooperatively define tongue and socket means for releasably mounting the closure means to the shroud.

In one form, the closure means comprises a one-piece suction blocking element.

The nozzle defines an opening which, in a number of forms, includes bridges extending across the opening. The suction blocking means, in the illustrated embodiment, is provided with recesses for accommodating the bridge elements when the closure means is installed in the nozzle.

The invention further comprehends provision of a power supply means removably mounted to the end of the wand opposite the end connected to the nozzle in electrically connected association with the power transmitting means for operating the powered brush in the absence of application of suction to the nozzle. Thus, the apparatus may be used independent of any canister and hose means conventionally used therewith when the apparatus is being used as a powder carpet cleaner when the power brush thereof is being energized through the removable power supply means.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
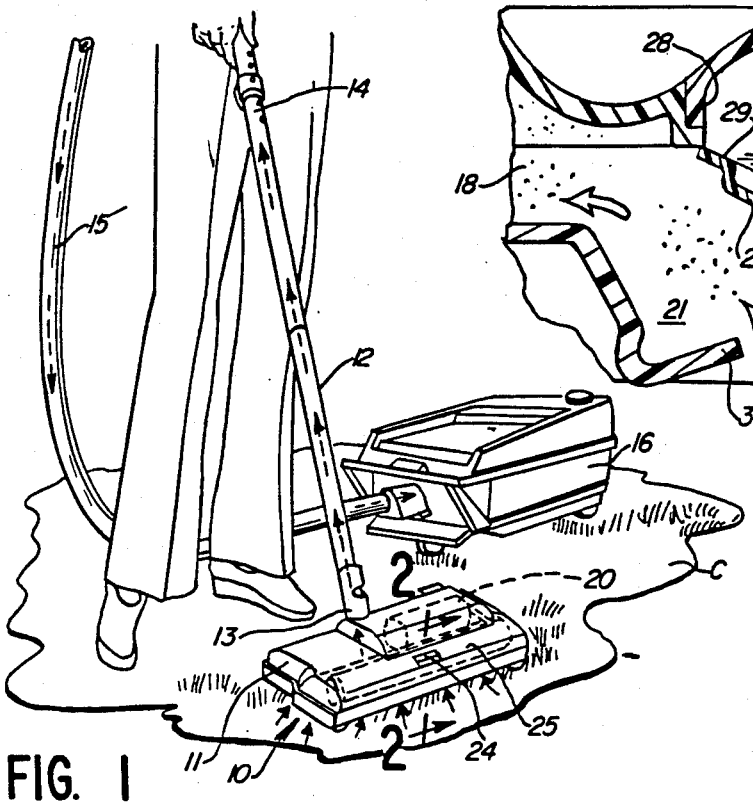
FIG. 1 is a fragmentary perspective view illustrating the use of the apparatus of the invention as a vacuum cleaner.

In the illustrative embodiment of the invention as illustrated in the drawing, a power driven brush unit, generally designated 10, is arranged for selective use as a powder carpet cleaner.

In the illustrated embodiment, as shown in FIG. 1, the power driven brush unit comprises a suction vacuum cleaner having a power nozzle 11, a tubular wand 12 connected at one end 13 to the nozzle. The opposite end 12 of the wand is connected through a flexible hose 15 to a conventional wheeled canister unit 16 defining the suction providing and dirt collecting means of the vacuum cleaner system.

Figure 2:
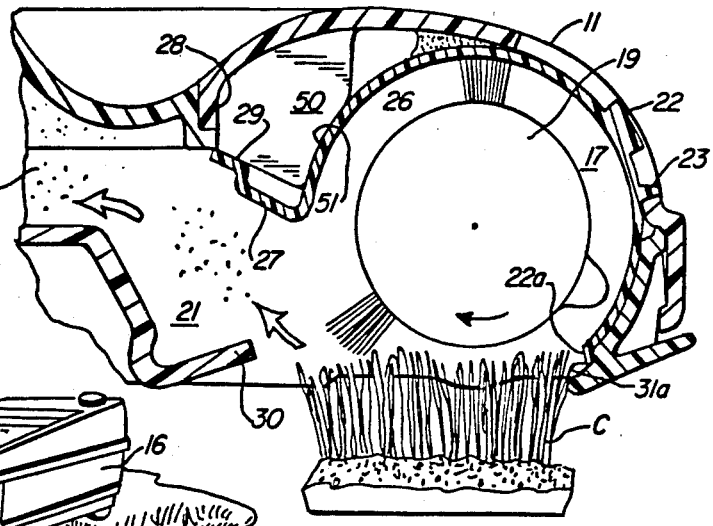
FIG. 2 is a fragmentary enlarged vertical section taken substantially along the line 2—2 of FIG. 1.
Figure 3:
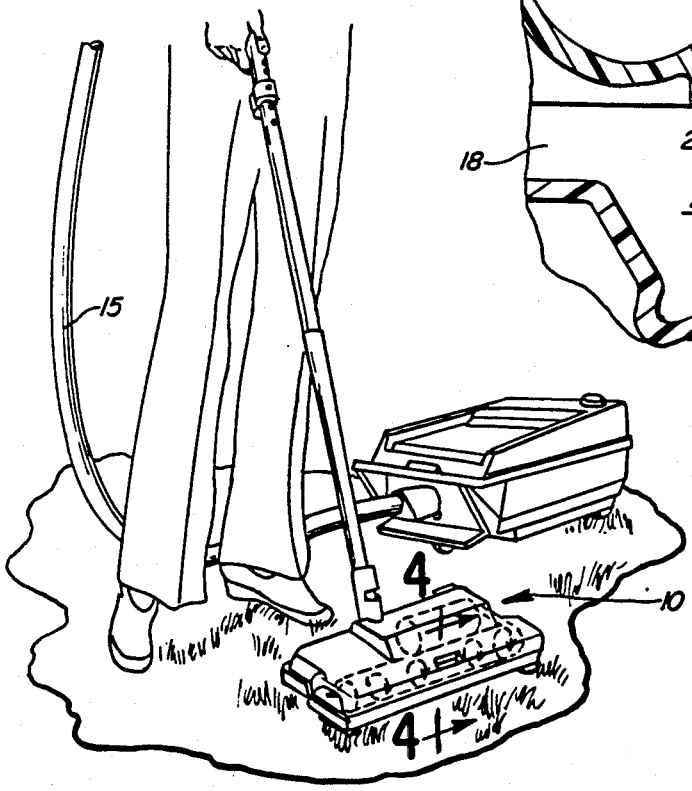
FIG. 3 is a fragmentary perspective view similar to that of FIG. 1 but illustrating the use of the apparatus as a powder carpet cleaner.

As illustrated in FIG. 2, nozzle 11 defines a suction space 17 opening to a passage 18 communicating with lower end 13 of the wand 12, permitting suction developed by canister 16 to be applied to the space 17 through the hose 15, wand 12, and passage 18. As further illustrated in FIG. 2, a power driven brush 19 is rotatably mounted to nozzle 11 in suction space 17 for loosening dirt and other material from the carpet C in carrying out normal vacuum cleaning operations with the apparatus 10. Illustratively, brush 19 is driven by a suitable electric motor 20 mounted in a rear portion of nozzle 11, as shown in FIG. 1. Electrical power for operating brush motor 20 is provided from canister 16 through suitable electrical conducting means (not shown) carried by hose 15 and wand 12 in the conventional manner.

As indicated briefly above, the invention comprehends the provision of means for converting the apparatus 10 selectively to a powder carpet cleaning apparatus, when desired. When cleaning carpeting, it is conventional to work into the carpeting by a suitable driven brush, a powder which is somewhat damp and sticky so as to effectively remove from the carpeting dirt and other material stubbornly embedded or impregnated into the carpet fibers, which would not be removed by the normal suction vacuum cleaning operation. Such carpet cleaning powder tends to clog the brush and the entrance portion 21 of passage 18. Further, because of the irregular configuration of the interior of the nozzle surrounding the suction space 17, such powder material tends to collect undesirably therein.

Figure 4:
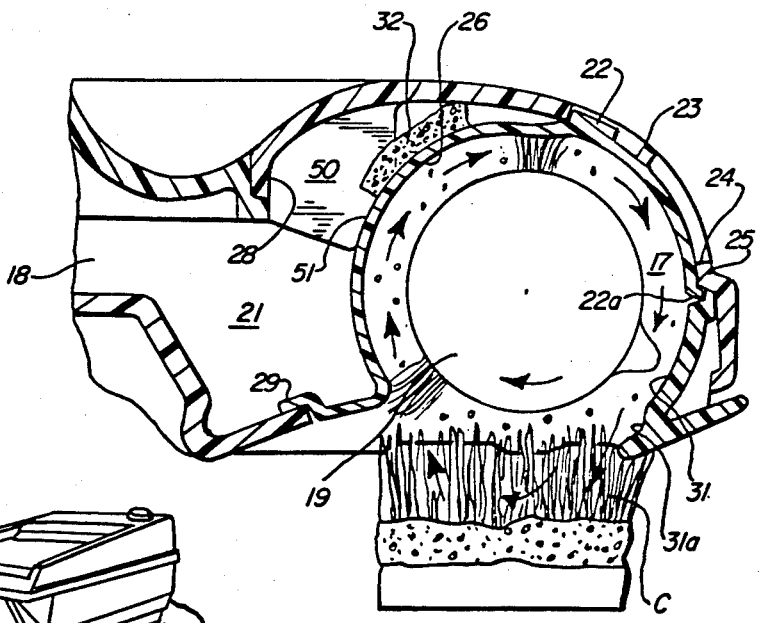
FIG. 4 is a fragmentary enlarged vertical section taken substantially along the line 4—4 of FIG. 3.

As shown in FIGS. 2 and 4, the present invention comprehends the provision of a novel shroud 22 movably mounted to the nozzle in suction space 17 for selective disposition in a retracted position, as illustrated in FIG. 2, permitting suction to be applied to the suction space 17 at brush 19 for picking up dirt loosened by the brush, and in an operative position, as shown in FIG. 4, preventing application of suction to space 17 through passage portion 21 for permitting the brush 19 to be operated as a powder carpet cleaning means.

As shown in FIGS. 2 and 4, shroud 22 may be manipulated to be selectively disposed in either the retracted position shown in FIG. 2, or the operative position shown in FIG. 4 by means of manipulating means 23 comprising raised portions on the shroud disposed through an access opening 24 in the front wall 25 of nozzle 11.

The curved shroud 22 includes a detent tab **22*a* on its lower front edge which is received and detained by a cooperating notch 31*a* formed in surface 31 in the retracted position of the shroud as shown in FIG. 2. In the operative position of shroud 22 shown in FIG. 4, the detent tab 22*a* is seated in a recess 25*a* formed at the juncture of the inside of wall 25 of nozzle 11 and the surface 31** at the lower front portion of the nozzle.

As shown in FIGS. 2 and 4, shroud 22 defines a smooth semicylindrical inner surface 26 surrounding the upper portion of the brush 19. The rear portion of the shroud is provided with a turned flange 27 abutting a downturned rib 28 in nozzle 11 when the shroud is disposed in the retracted disposition shown in FIG. 2. Flange 27 is provided with an offset distal end 29 which seats against a forwardly projecting flange 30 defining the lower edge of the inlet portion 21 of passage 18, when the shroud is disposed in the operative position of FIG. 4. In the retracted disposition of FIG. 2, flange 27 serves as a guide at the top of passage portion 21 for directing the air flow from suction space 17 to the passage 18.

The nozzle 11 may advantageously include one or more walls forming support ribs 9, each having a curved bearing surface **9*a* disposed closely adjacent the back side of the curved wall structure forming movable shroud or shutter 22. Two support ribs 9 are provided in the embodiment of FIGS. 1 through 4, one on each side of access opening 24. Since the rib bearing surface 9*a* and the portion of the wall of shroud 22 cooperating with it have the same curvature, the ribs 9 provide effective bearing surfaces for shroud 22**. These bearing surfaces facilitate manipulation of the shroud between retracted and operative positions.

As shown in FIG. 4, front wall 25 of the nozzle is segmentally cylindrical and includes a lower portion defining the smooth cylindrical surface 31 cooperating with the surface 26 of shroud 22 and providing a smooth cylindrical wall means surrounding the brush 19 and opening downwardly to the carpet C when the shroud is in the operative position of FIG. 4.

In addition to the detent tab **22*a* there is a resiliently compressible element 32 secured to the shroud for compression between the shroud and nozzle wall for sealing around access opening 24 in nozzle 11** and for yieldingly helping to retain the shroud in the retracted disposition. Additionally, the shroud may be formed of resiliently deformable material, such as a suitable synthetic resin, so that the shroud tends to be further retained in the selected disposition by its own tendency to expand against the confronting nozzle surfaces.

Figures 5, 6, 7, 8, 9, 10:
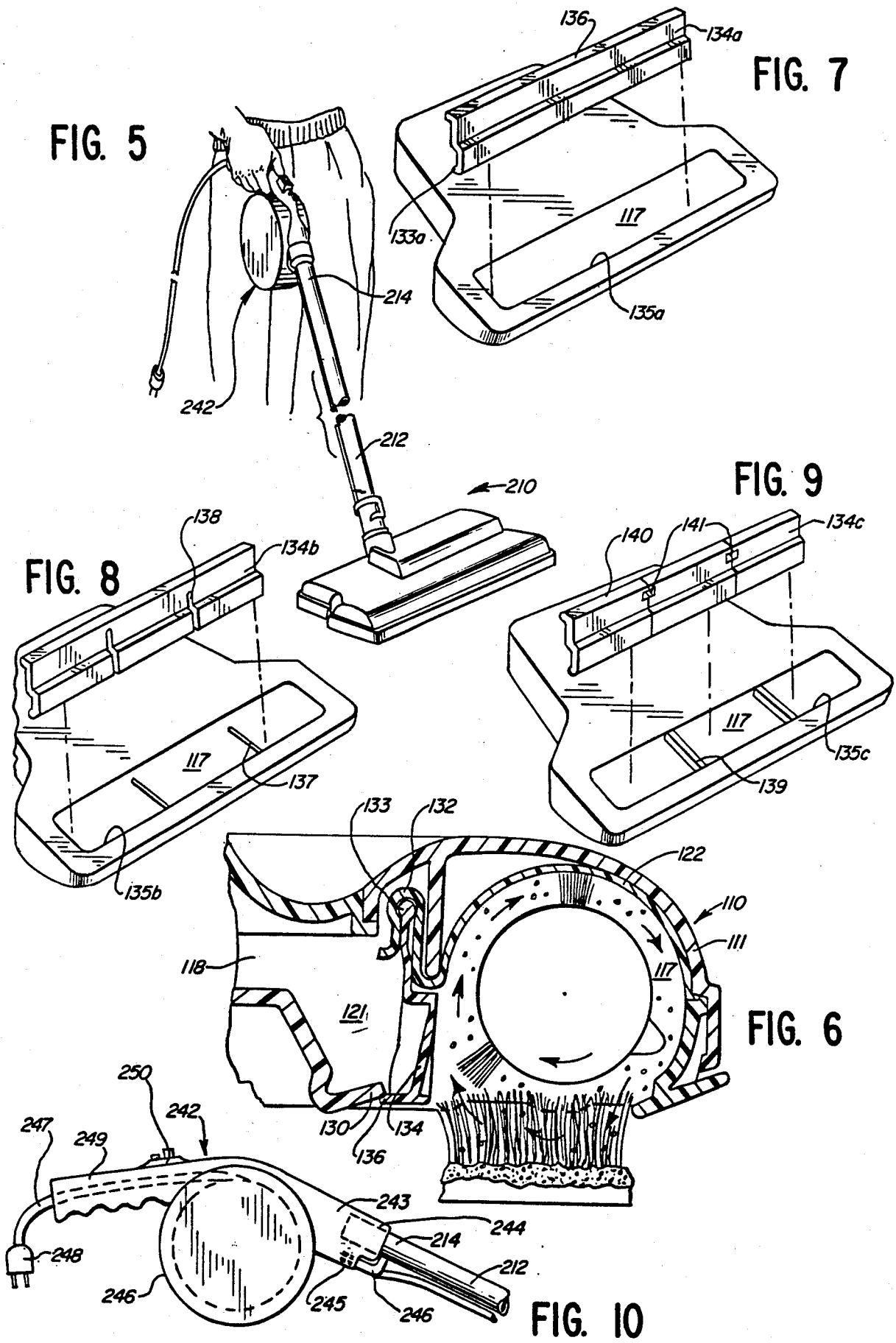
FIG. 5 is a fragmentary perspective view illustrating a modified form of the invention permitting the use of the wand and nozzle independently of the canister and suction hose when using the apparatus as a powder carpet cleaner.
FIG. 6 is a fragmentary enlarged vertical section similar to that of FIGS. 2 and 4, but illustrating a modified form of the invention.
FIG. 7 is an exploded view illustrating one form of closure means used in association with the shroud of FIG. 6.
FIG. 8 is a fragmentary exploded view illustrating another form of closure means.
FIG. 9 is an exploded view illustrating still another form of closure means.
FIG. 10 is a fragmentary side elevation illustrating in greater detail the replacement power supply means of FIG. 5.

In a modified form of the invention as illustrated in FIG. 6, the power driven brush unit generally designated 110 comprises a unit similar to unit 10 but having a modified shroud 122 fixedly secured to the nozzle 11 in overlying relationship to the upper portion of the suction space 117.

Shroud 122 includes a rear socket portion 132 opening downwardly toward passage inlet portion 121 so as to releasably receive an upper tongue portion 133 of a closure 134 comprising a dam extending across the inlet 121 for selectively blocking application of suction to space 117 from the passage 118.

Closure 134 may be provided in different forms, as illustrated in FIGS. 7, 8 and 9, depending on the arrangement of the inlet opening to the suction space 117. Thus, where the inlet opening 135*a* comprises a fully open opening, the closure element 134*a* may comprise a one-piece blocking element with one integral edge defining the tongue 133*a* and the opposite, lower edge defining a turned sealing edge 136 having sealing engagement with the nozzle flange 130, in the installed disposition of the closure as illustrated in FIG. 6.

Wherein the opening comprises an opening, such as opening 135*b* shown in FIG. 8, having a plurality of bridging elements 137 thereacross, the closure 134*b* is provided with a corresponding plurality of recesses 138 accommodating the bridging elements 137 in the installed disposition.

Where bridging elements 139 are molded integrally with the nozzle to extend across the opening 135*c*, as shown in FIG. 9, the closure 134*c* may be provided in the form of a plurality of end-to-end segments 140, with the confronting juxtaposed ends thereof cooperatively defining through openings 141 for receiving the bridges 139 upon installation of the respective segments in the nozzle.

A further modified form of the invention is illustrated in FIGS. 5 and 10 wherein the hose 15 and canister 16 are disconnected from the wand 12 and a substituted power supply means generally designated 242 is utilized. As shown, the power supply means defines a housing 243 having one end 244 fitted to the wand end 214 for removably mounting the power supply means to the wand. An electrical connector 245 is provided also in the housing end 244 for quick connection to the connector 246 carried on the wand 212 as an incident of mounting of the power supply 242 to the wand.

The power supply means further includes a wire cord reel 246 for retractably holding a length of electrical power cord 247 having a conventional power supply plug 248 at its distal end.

As further shown in FIG. 10, housing 243 further defines a rear handle portion 249 for manual grasping by the user, as illustrated in FIG. 5. An on-off switch 250 is provided at the forward end of handle portion 249 for facilitated control of the operation of motor 20.

Power supply means 242 is readily mounted to the upper end 214 of the wand 212 upon removal of the end of hose 15 therefrom. The quick connect electrical connection means 245,246 provides automatic connection of the brush motor to the conductor cord 247 through switch 250.

Thus, with the unit 210 utilized as a powder carpet cleaner as illustrated in FIG. 5, facilitated cleaning of the carpet C may be effected without the need for moving the hose and canister with the unit. Upon completion of the step of brushing the powder carpet cleaner into the carpet with the unit as arranged in FIG. 5, the user simply disconnects the power supply means 242 and reconnects the suction hose 15 to the wand end 14 for further use of the vacuum cleaner, as shown in FIG. 1, in removing the powder cleaner and soil and other materials picked up thereby from the carpet in a subsequent normal vacuum cleaning operation.

The vacuum cleaner structure of the present invention is extremely simple and economical of construction while yet providing improved facilitated convertibility and functioning as discussed above.

The foregoing disclosure of specific embodiments is illustrative of the broad inventive concepts comprehended by the invention.

We claim:

1. In a vacuum cleaner apparatus including a nozzle, a wand opening at one end to within said nozzle for moving the nozzle over a floor surface to be cleaned, said wand being adapted to conduct to a canister having suction creating means and first power supply means dirt picked up by the nozzle as a result of suction applied to said nozzle through said wand by the canister suction means, a powered brush rotatably carried by the nozzle, end power transmitting means carried by the wand and adapted to be removably connected to the canister first power supply means for causing selective operation of the powered brush and adapted to be connected through said first power supply means to a power source when suction is applied to the nozzle, improved means for selectively preventing transfer of dirt to said wand from said nozzle while concurrently permitting energization of said powered brush by said power transmitting means to effect a working of powder cleaner lying on said floor against the floor surface by said brush, said improved means comprising:

a shroud;

means for mounting said shroud movably within said nozzle to extend partially about said brush and block said wand one end; and second power supply means removably mounted to said wand adjacent the end of the wand opposite said one end in electrically connected association with said power transmitting means for operating said powered brush from a power source when said wand is disconnected from the canister.

2. The vacuum cleaner structure of claim 1 wherein said second power supply means includes a wire cord storage reel.

3. The vacuum cleaner structure of claim 1 wherein said second power supply means defines a manipulating handle.

4. The vacuum cleaner structure of claim 1 wherein said second power supply means includes an On-Off control switch for selectively energizing the powered brush.

5. The vacuum cleaner structure of claim 1 wherein said second power supply means and power transmitting means on the wand cooperatively define quick-connect electrical connector means.

6. In a floor cleaner apparatus including a nozzle, means including a wand for moving the nozzle over a floor surface to be cleaned said wand being adapted for communicating a dirt collector with said nozzle a powered brush rotatably carried by the nozzle, and power transmitting means carried by the wand for causing selective operation of the powered brush and adapted to be connected to a first power source when suction is applied to the dirt collector, improved means for selectively energizing said powered brush by said power transmitting means to effect a working of powder cleaner lying on said floor surface against the floor surface by said brush, said improved means comprising:

a shroud;

means for mounting said shroud movably within said nozzle to extend partially about said brush and selectively block said dirt collector; and power supply means for selectively delivering power to said power transmitting means from a second power source remotely of said nozzle in the absence of connection of said wand to said dirt collector and with said shroud disposed to block the connection of said dirt collector to said nozzle.

7. The vacuum, cleaner structure of claim 6 wherein said power supply means includes a power cord storage device.

8. The vacuum cleaner structure of claim 6 wherein said power supply means defines a manipulating handle.

9. The vacuum cleaner structure of claim 6 wherein said power supply means includes an On-Off control switch for selectively energizing the powered brush means.

10. In a floor cleaner apparatus including a nozzle, means including a wand for moving the nozzle over a floor surface to be cleaned, said wand being adapted for communicating a dirt collector with said nozzle a powered brush rotatably carried by the nozzle, and power transmitting means carried by the wand for causing selective operation of the powered brush and adapted to be connected to a first power source when suction is applied to the dirt collector, improved means for selectively energizing said powered brush by said power transmitting means to effect a working of powder cleaner lying on said floor surface against the floor surface by said brush, said improved means comprising power delivery means comprising a flexible power cord for selectively delivering power to said power transmitting means from a second, stationary power source when said wand is not in communication with said dirt collector.

11. In a floor cleaner apparatus including a nozzle, means including a wand for moving the nozzle over a floor surface to be cleaned, said wand being adapted for communicating a dirt collector with said nozzle, a powered brush rotatably carried by the nozzle, and power transmitting means carried by the wand for causing selective operation of the powered brush, improved means for selectively energizing said powered brush by said power transmitting means to effect a working of powder cleaner against the floor surface by said brush, said improved means comprising means for selectively (a) delivering power to said power transmitting means from a first power source concurrently with suction being applied to said dirt collector, and (b) delivering power to said power transmitting means from a second power source in the absence of suction applied to said dirt collector, said power delivery means including a power cord storage device removably mounted to said wand.

12. The vacuum cleaner structure of claim 10 wherein said power delivery means defines a manipulating handle on said wand.

13. The vacuum cleaner structure of claim 10 wherein said power delivery means includes an On-Off control switch for selectively energizing the powered brush means.

14. The vacuum cleaner structure of claim 11 wherein said power cord storage device removably mounted to said wand comprises a power cord storage reel.

* * * * *